US005344049A

United States Patent [19]

MacDonald

[11] Patent Number: 5,344,049

[45] Date of Patent: Sep. 6, 1994

[54] VINYL OR PLASTIC DISPENSING TUBE FOR PASTES, CREAMS, OR GELS

[76] Inventor: Florence C. MacDonald, 8113 High Point Blvd., Brooksville, Fla. 34613

[21] Appl. No.: 83,359

[22] Filed: Jun. 28, 1993

[51] Int. Cl.[5] ..... B65D 35/08

[52] U.S. Cl. ..... 222/107; 222/99

[58] Field of Search ..... 222/1, 99, 92, 107, 222/100, 103; 132/247–249

[56] References Cited

U.S. PATENT DOCUMENTS 2,430,046 11/1947 Dreyfus ..... 222/107

4,733,800 3/1988 Bjorkengren et al. ..... 222/107

4,807,782 2/1989 Meinerding et al. ..... 222/107 X 5,082,144 1/1992 Sundstrom ..... 222/99

5,108,008 4/1992 Ryder ..... 222/99

*Primary Examiner*—Gregory L. Huson

*Attorney, Agent, or Firm*—Charles E. Lykes, Jr.

[57] ABSTRACT

An improved dispensing tube for a paste, cream, or gel in which a flexible or resilient dispensing tube is adapted with one or more fastening strips. The fastening strips are constructed of adequate strength and positioned along said tube so that the tube may be secured as it is rolled up from its closed towards its dispensing end.

3 Claims, 3 Drawing Sheets

VINYL OR PLASTIC DISPENSING TUBE FOR PASTES, CREAMS, OR GELS

FIELD OF THE INVENTION

The invention relates to tubular fluid, or semi-fluid, dispensing devices, particularly with respect to dispensers of toothpaste and other cream-like devices. Reference is made to Disclosure Document No. 326195, filed by the inventor on Mar. 4, 1993.

BACKGROUND OF THE INVENTION

A variety of health and sanitary products exist in the form of creams, pastes, and gel. Materials of this consistency are also found with construction, maintenance, and mechanical arts as well as in arts and crafts in various forms of adhesives, paints, lubricants, and cleaning materials. It is helpful to fashion a container for such materials which permits quick and easy dispensing and then resealing of the container in order to protect them from exposure to air or other adverse environment or to prevent breakage. Such containers frequently are used for toiletries, such as toothpaste. It would be helpful to have the ability to compact the storage area for travel or shelf space.

A variety of prior art devices have made efforts at solving this problem. There are several varieties of pump canisters. These are generally characterized by a chamber to hold the fluid which can be compressed by depressing a bottom or other leverage device. The dispensed material is forced out through a one-way valve or perhaps a capped or sealed opening. The opening may either be automatically closed, or it may be sealed and capped by the user. Such devices incorporate moving parts and require assembly with respect to the compression apparatus and may also have such parts with respect to the valve. U.S. Pat. No. 4,508,239, issued to Royzen on Apr. 2, 1985, and U.S. Pat. No. 4,258,864, issued to Karamanolis, et al, on Mar. 31, 1981, are examples of such devices.

Other varieties of such devices include an outer container and an inner, compressible, container. The outer container contains or buttresses a compression force and the inner container holds the material to be dispensed. The material may again be sealed off with either a one-way valve or by some other form of sealing and capping apparatus. U.S. Pat. No. 4,099,651, issued to yon Winkelmann, on Jul. 11, 1978, is an example of such a tube.

Well known and long used in this are simple tubes wherein one end of the tube is permanently sealed, or closed (perhaps by heat fusion or the use of adhesives) and the other end is adapted with a capped opening. The material may then be forced out through the capped opening by squeezing the tube. Many such devices are made with a foil material. As such, the tube surface is pliable yet, after squeezing, will hold its new shape. This prevents undesired air or other fluid material from building up within the chamber.

The use of foil presents a unique problem. While foil is pliable and bendable, it also is subject to splitting and tearing. After being bent back and forth several times at the same place, or if a given spot is bent too forcefully or radically, a foil tube may split or tear and permit leakage. An advantage of foil is that the closed end of the tube may be rolled up towards the open end so that, as fluid is squeezed from the tube, the closed end may be rolled up and the size of the tube may be compacted for storage. This also makes it easier to squeeze additional paste or fluid from the tube.

Recently the use of plastics and vinyl materials has become more widespread in the packaging of consumer goods. With respect to such tubes, it offers several distinct advantages. First, it is less costly than foil. Second, it is lighter and more plentiful than foil. Additionally, it is easier to work with than foil. Such tubes could easily be made from plastic or vinyl, either through the injection molding process or by heat fusing sheets of plastic or vinyl together.

Unlike foil, however, plastic or vinyl will normally be resilient and, after squeezing is complete, will tend to spring back to its original shape or configuration. As a result of this, the tube will draw air or other fluid back into the container when squeezing is complete to fill in the space left by the evacuated paste or cream. Accordingly, this precludes the space saving benefit of foil tubes.

Additionally, the paste or cream will be free to drift about the interior of the tube. As a result, it will frequently be necessary to shake or manipulate the container in some way in order to force the paste or cream into position near the opening to be squeezed out. Even so, it may be necessary to position the tube with the opening down in order to ensure that the paste or cream does not flow back into the open spaces of the tube. This also makes it difficult to apply pastes or creams to surfaces which are either vertically-oriented or downward facing.

U.S. Pat. No. 4,576,314, issued to Elias, et al on Mar. 18, 1986, and U.S. Pat. No. 5,105,985, issued to Kroeber, on Apr. 21, 1992, each teach means and apparatus for assisting in the solution of this problem. Elias teaches a tubular sleeve which is adapted with a roll-up channel and winged winding shaft. The closed tube end may be positioned within the channel. As paste, cream, or gel is squeezed from the tube, the shaft can be turned and the emptied tube can be rolled up within the tubular sleeve.

Kroeber teaches an insert within the tube to inhibit the backflow of air or other undesired gas back into the tube. Kroeber does not teach a means of storing or positioning the emptied tube.

U.S. Pat. No. 4,365,727, issued to Shmelkin on Dec. 28, 1982, teaches a device specifically developed for use with plastic tubes. It comprises a hinged apparatus through which the closed end of a tube may be inserted. It further comprises a roller and channels for assisting in squeezing the tube and then sliding the emptied portion through. Contact with a roller is meant to facilitate thorough squeezing of the fluid from the tube.

Kroeber does not teach means of handling the emptied tube. Elias and Shmelkin each require moving parts and a separate apparatus. Neither Elias nor Shmelkin permit a user to ensure that all of the fluid material has been squeezed from the tube. While it is likely that this would naturally occur in the use of the Elias device, it can be seen that fluid could remain in the tube while passing under the roller of the Shmelkin device.

What is needed, but not provided by the prior art, is such a low cost, lightweight, tube for pastes and creams which will achieve the utilitarian advantages of pastes or creams and preserve the cost and manufacturing advantages provided by the use of vinyl and plastic. It would be particularly helpful to provide such a tube which would so function without the use of additional or moving parts and to conserve storage space.

SUMMARY OF THE INVENTION

The inventor has overcome the problems inherent in the prior art by adapting the closed end of the tube with a fastening strip or apparatus. After the tube has been squeezed, the closed end of the tube may be rolled up and the fastening strip or apparatus may be engaged in order to hold the otherwise resilient vinyl or plastic material in place. This accomplishes all of the objectives of preserving storage space, protecting the paste or cream from intrusion by undesired fluids or air, and keeping the paste or cream positioned for the next occasion of use.

Such a strip could take on a variety of structures or configurations. In one such configuration, a pliable metal wire could be housed within a sleeve along the closed end of the tube and then out beyond either side of the tube. After paste or cream is squeezed from the tube, the closed end may be rolled up and then the pliable strip may be folded up over the rolled-up portion of tube. By selecting a sufficiently strong strip material, such as a metallic wire, the folded strip will prevent the tube from again unraveling.

It is, then, an object of the present invention to provide a plastic or vinyl tube for the dispensing of pastes or creams which will provide the advantages of tubes made from foil.

It is a further object of the present invention to provide a plastic or vinyl tube for pastes and creams which is adapted with a fastening strip or apparatus to permit the dispensing tube to be rolled or folded as paste or cream is dispensed and held in such new position.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

DETAILED DESCRIPTION OF THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

Figure 1:
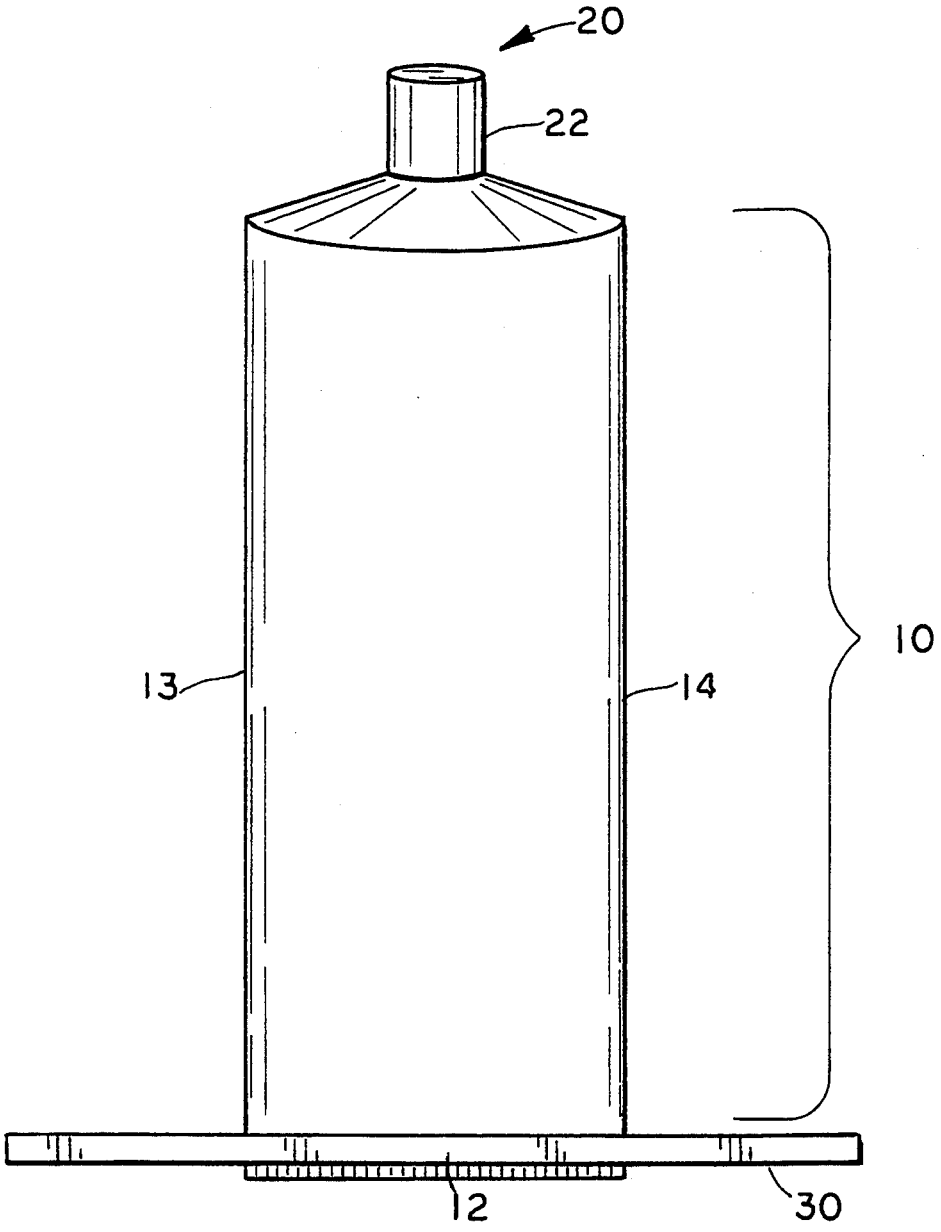
FIG. 1 is a front view of the tube so configured, depicting the fastening strip along the closed end and protruding out beyond the sides of the tube.

Making reference first to FIG. 1, it can be seen that an integral tube body (10) is adapted with an open end (20) through which a paste or cream (not depicted in FIG. 1) stored within the tube (10) may be squeezed. At the closed end (12) of the tube (10) is provided an elongated strip (30), which runs along or near the closed end (12) of the tube (10) and protrudes out beyond the sides (13, 14) of the tube for some length (32). This strip (30) is generally oriented in a direction (14) perpendicular to the "length" of the tube (10). Of course, the strip (30) need not be straight or even one piece. It could be crooked or in two pieces. The strip (30) will have ends (37, 38), at least one of which protrudes out beyond the closed end (12) .

Figure 2:
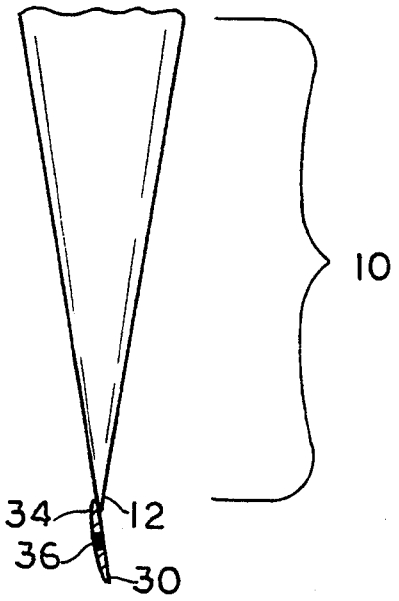
FIG. 2 depicts an enlarged cross-section of a fastening strip as attached to a tube for dispensing pastes or creams.

Making reference to FIG. 2, a cross-section of the strip (30) is depicted. It shows an outer cover (34) and an enclosed wire-like member (36). As depicted in FIG. 2, the strip (30) is enclosed within the construction of the closed end (12) of the tube (10). The outer cover (34) should be of a material or configuration which will hold the wire-like member (36) within and in place along the tube closed end (12), but not to interfere with the bending of the wire-like member (36).

Figure 3A:
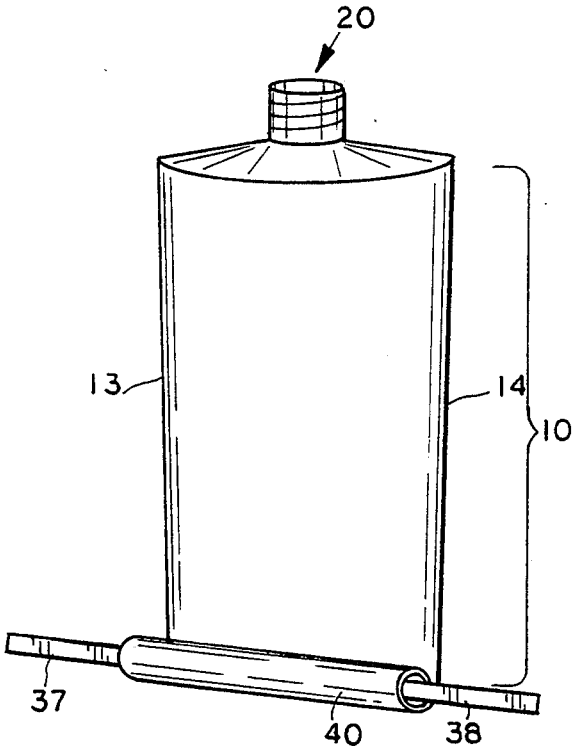
FIGS. 3A and 3B depict such a tube partially rolled up with the fastening strip in the unengaged and engaged positions, respectively.
Figure 3B:
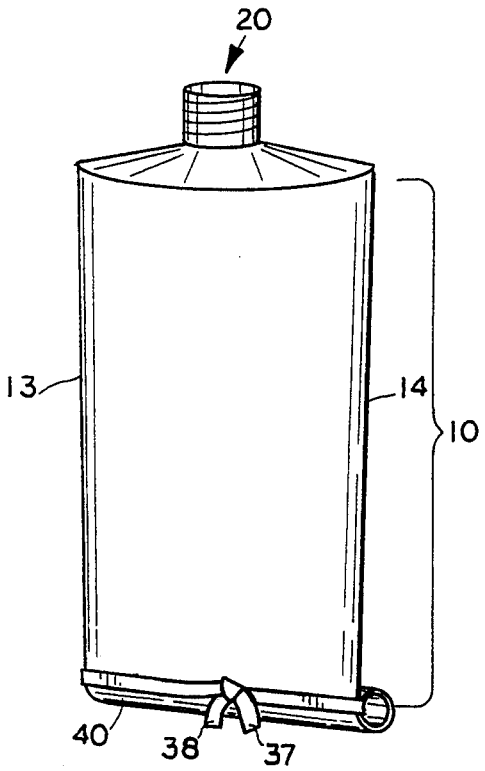

Making reference now to FIGS. 3A and 3B, the operation of the preferred embodiment of the present invention is described. The tube cap (22) or other sealing device is removed, the tube (10) may then be squeezed at any convenient point (18) along its body in order to compress the paste, cream, or gel (not depicted) through the open end (20) left exposed by the cap (22).

At this point, the closed end (12) may be rolled up until the paste, cream, or gel (not depicted) approaches the open end (20), at which time the cap (22) may (but need not) be repositioned to close the open end (20). The advantage of reclosing the open end would be to prevent any backflow of air or undesired gas.

Having rolled up the closed end (12) of the tube (10), having eliminated and prevented voids within the tube from forming by preventing the backflow of gas, and having rolled the tube (10) into a more compact configuration, the present invention permits the tube (10) to be held in this advantageous configuration. By folding either or both retaining strip ends (37, 38) over the rolled tube portion (40), the tube (10) will be held in this position.

It is appropriate at this point to consider several alternatives to this form of fastening strip. For instance, a fastening strip could be made of an integral foil material such that no outer cover (34) would be required. The foil strip could then be fastened along the tube closed end (12) so that the protruding ends can be folded over the rolled-up tube (10).

As an additional alternative, the strip would not require the use of a wire-like member and could be of a less substantial material, but further adapted with a fastening device, such as a clip, to grasp the other end. In this manner, the strip would not be of integral construction and would require the incorporation of moving parts. While this is not quite as simple to operate as the preferred embodiment, it does capture many of the advantages of the present invention. Additionally, the fastening strip could be of adequate length to permit tying the two ends together.

Figure 4:
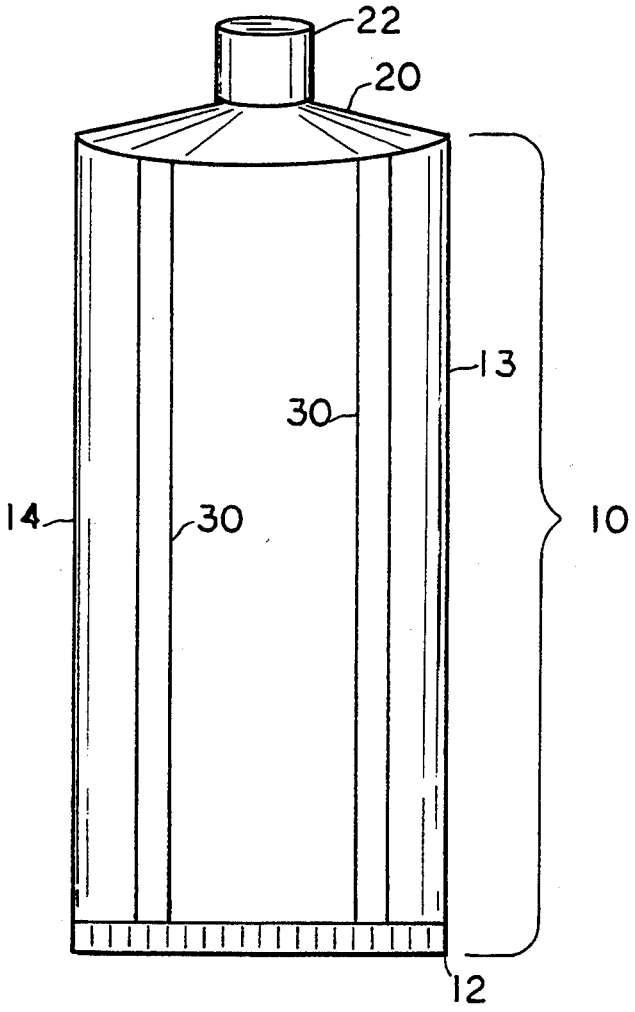
FIG. 4 depicts an alternative embodiment in which one or more fastening strips are positioned along the length of the tube.

One substantial alternative to this preferred embodiment is available. Reference is made to FIG. 4. By positioning one or more strips (30) enclosing such a pliable wire-like metal along the length of the tube (10), the tube can be held into position without the use of a protruding strip member or the need to fold the strip over the rolled end. While keeping within the spirit and scope of the present invention, such alternative offers the advantage described above, but requires the disadvantage of complicating construction and manufacture.

It should also be noted that the invention has been described with respect to the use of a vinyl or plastic tube. The invention is meant to be used in conjunction with a flexible or resilient tube. While most such tubes are presently made of plastic or vinyl, the spirit and scope of the present invention may be equally applicable to its use with a flexible and resilient tube made of any material including such which may not be commonly known in the present art.

Further modification and variation can be made to the disclosed embodiments without departing from the subject and spirit of the invention as defined in the following claims. Such modifications and variations, as included within the scope of these claims, are meant to be considered part of the invention as described.

What is claimed is:

1. A dispensing tube for pastes, creams, or gels, the dispensing tube further comprising;

an elongated tube made of a flexible but resilient material, said tube further comprising a closed end which is configured in a line and an opposite end which is adapted with an opening through which said paste, cream, or gel may be forced by compressing the tube;

said closed end being further adapted with a fastening strip, said fastening strip being adapted to extend out beyond the closed end line in one or both directions;

said fastening strip further comprising a flexible sheath within which a pliable wire is housed, said sheath being fastened to or along said seam and protruding out from said seam on one or both ends a distance sufficient to substantially wrap around said tube as it may be rolled up from said closed end toward said opposite end;

said metallic wire being positioned within the length of said sheath and of adequate strength to hold said rolled tube in place; and said fastening strip further being of adequate length and strength to substantially surround said tube and hold it into position as it may be rolled up from said closed end toward said open end.

2. The invention described in claim 1 in which said fastening strip ends are of sufficient length and pliability to surround said rolled closed end and to be securely and alternately intertwined with one another so as to hold the rolled closed tube end in place and then separated to allow the rolled closed tube end to be further rolled up the length of the tube.

3. The invention described in claim 1 in which said sheath is formed by extending the length of said seam beyond the sides of said tube closed end so as to have a length sufficient to house said fastening strip and adapting said seam with an elongated cavity for housing said fastening strip.

* * * * *